US005711077A

United States Patent [19]

Schulz et al.

[11] Patent Number: 5,711,077

[45] Date of Patent: Jan. 27, 1998

[54] DOUBLE BLADE ACTUATOR FOR A HAND HELD CUTTER BLADE ASSEMBLY

[75] Inventors: William J. Schulz, Mosinee; Brian L. Adkinson, Wausau, both of Wis.

[73] Assignee: Fiskars Inc., Madison, Wis.

[21] Appl. No.: 660,918

[22] Filed: Jun. 10, 1996

[51] Int. Cl.[6] ..... B26B 29/02; B26B 29/06

[52] U.S. Cl. ..... 30/160; 30/319; 30/335

[58] Field of Search ..... 30/160, 161, 162, 30/319, 307, 347, 335

[56] References Cited

U.S. PATENT DOCUMENTS 4,124,939 11/1978 Onoue ..... 30/161

5,299,355 4/1994 Boda et al. .

5,301,428 4/1994 Wilcox ..... 30/162

*Primary Examiner*—Douglas D. Watts

*Attorney, Agent, or Firm*—Foley & Lardner

[57] ABSTRACT

A rotary cutter including a handle, a cylindrical head formed on one end of the handle and having a planar surface on each side, the handle and head having an interval cavity, an actuating member mounted in the cavity in the handle and head, a blade support formed on the actuating member for movement between a storage position and one of two operating positions with respect to the head, a spring mounted on the actuating member for biasing the actuating member to ta storage position and a latch assembly formed in the actuating member for electively locking the actuating member in one of the two operating positions.

5 Claims, 4 Drawing Sheets

DOUBLE BLADE ACTUATOR FOR A HAND HELD CUTTER BLADE ASSEMBLY

FIELD OF THE INVENTION

The present invention relates to a hand held rotary cutter assembly and more particularly to an actuator having two operative positions to accommodate two different size cutter blades.

BACKGROUND OF THE INVENTION

Hand held rotary cutters of the type contemplated herein as shown in U.S. Pat. No. 5,299,355, entitled "Rotary Blade Actuator For A Hand Held Cutter," issued on Apr. 5, 1994. The hand held cutter of this patent provides a unitary actuator for moving rotary cutter blade between a storage and an operative position with respect to a handle. A spring section is provided in the cutter for biasing the blade to the storage position. A limit stop is provided on the actuator which holds the blade in a cutting or operative position and a thumb actuated button for releasing the blade for movement to the storage position. A finger guard is formed as an integral part of the handle and a blade guard is mounted on the blade to cover the upper quadrant of the blade in both the operative and inoperative positions of the blade.

SUMMARY OF THE PRESENT INVENTION.

The present invention relates to a hand held rotary cutter having a unitary actuator for moving a rotary cutter blades between a storage position and one of two operative positions with respect to the handle. The actuator is provided with two limit stops which are selectively positioned to accommodate a small circular blade, 45 mm or a large circular blade, 65 mm. A safety feature in using the small blade is provided wherein both hands are required to position the small blade in the extended position. The small blade is returned to the storage position in two steps. A blade guard is provided on the cutter which is designed to protect the operator at both rotary blade positions.

Other principal features and advantages of the invention will become apparent to those skilled in the art upon review of the following drawings, the detailed description and the appended claims.

Figure 1:
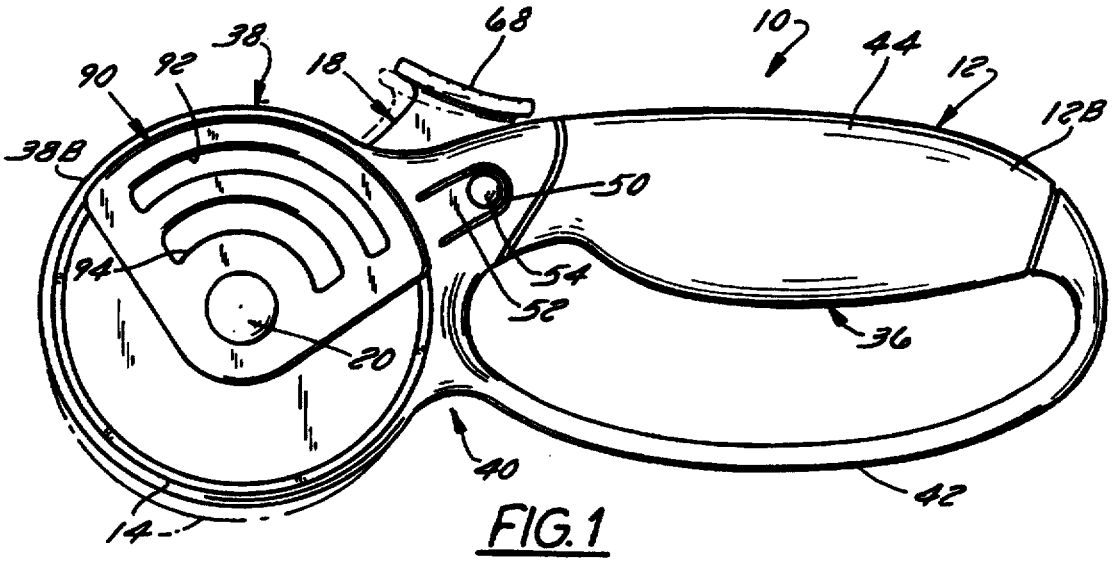
FIG. 1 is a side view of the hand held rotary cutter in accordance with the present invention.
Figure 2:
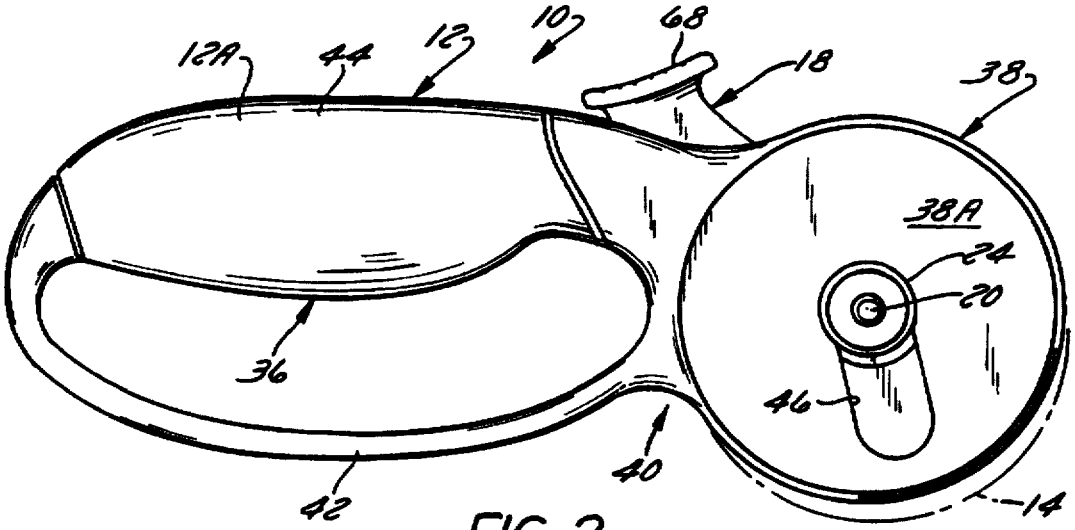
FIG. 2 is a view of the opposite side of the rotary cutter shown in FIG. 1.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Figure 3:
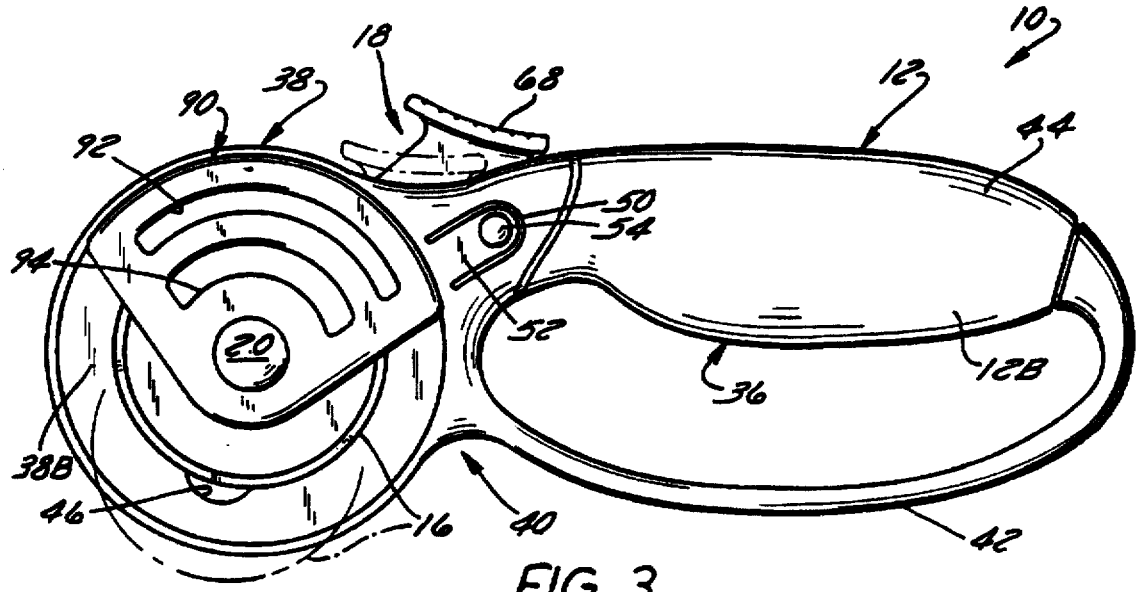
FIG. 3 is a side view of the rotary cutter shown in FIG. 1 with the small cutter blade shown in phantom.
Figure 5:
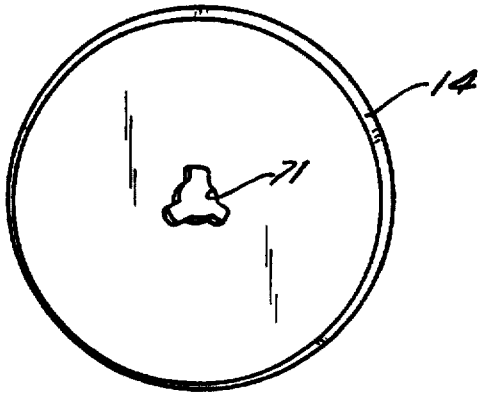
FIG. 5 is a side view of a 65 mm cutter blade.
Figure 6:
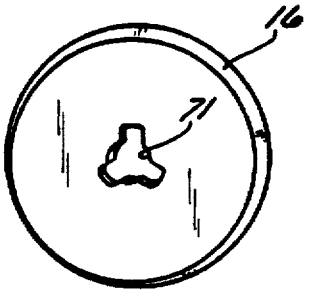
FIG. 6 is a side view of a 45 mm cutter blade.
Figure 4:
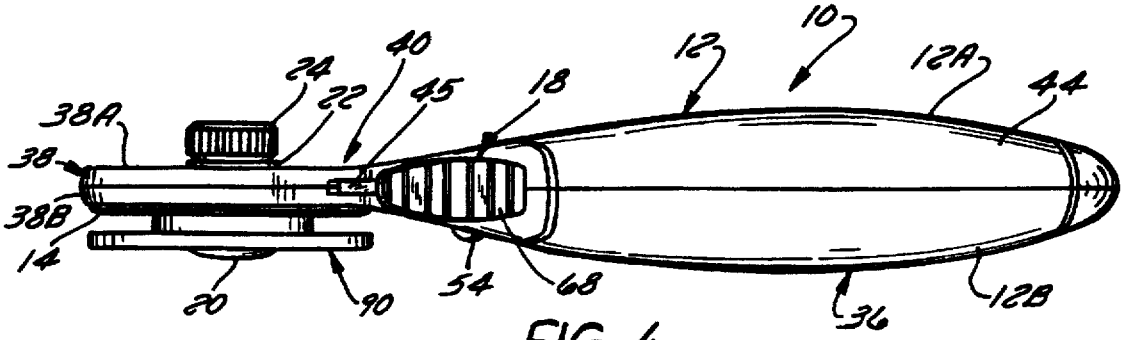
FIG. 4 is a top view of the rotary cutter.
Figure 7:
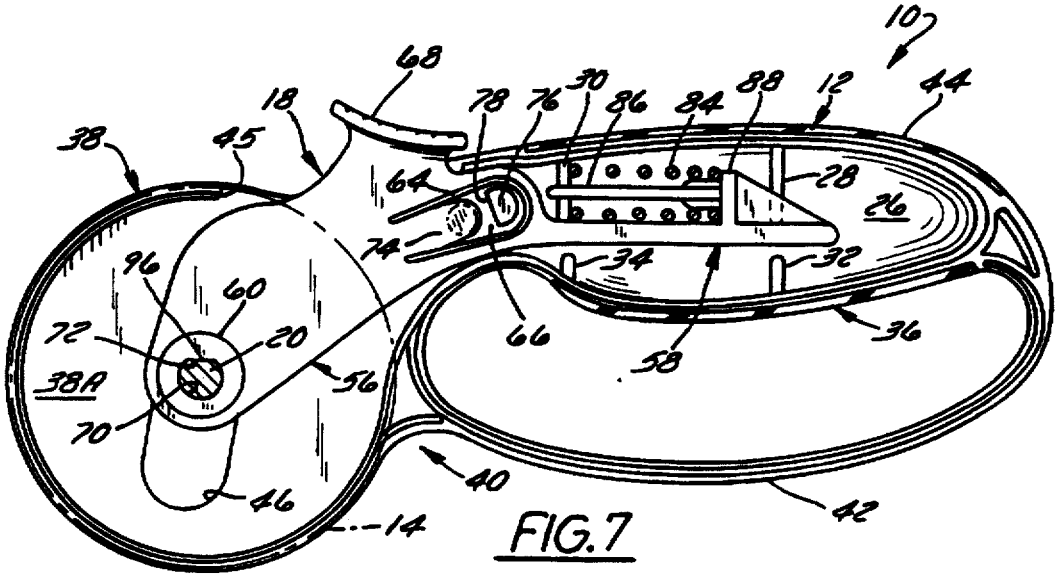
FIG. 7 is a side view of the rotary cutter with the side wall removed to show the double snap lock assembly for extending and retracting the cutter blades.

The rotary cutter 10 according to the present invention as shown in FIGS. 1 through 4 includes a main body 12, a pair of disc shaped blades 14 and 16, FIGS. 5 and 6, of different diameters and a blade actuator 18 for moving the blades to different cutting positions. The main body 12 as shown in FIG. 4 is formed of symmetrical side walls 12A and 12B which on assembly form an interior cavity 26 therebetween as shown in FIG. 7. Each side wall includes a partition 28 on the inside of the back of the side wall and a partition 30 on the inside of the front of the side wall. Each set of partitions are spaced apart to provide room between the partitions for movement of the actuator 18 in the handle 12. Panels 32 and 34 are provided on the bottom of the side walls 12A and 12B in a spaced relation to partitions 28 and 30 to support the actuator.

The body 12 includes a hand grip portion or handle 36 and a cylindrical head 38 interconnected with the handle by a neck section 40. A finger guard 42 is provided along the length of the hand grip section 36. It should be noted that the hand grip section 36 includes a resilient cover 44 in the form of a compressible elastomeric material to provide a resilient grip.

The body 12 when assembled includes a cylindrical head 38 having substantially flat side walls 38A and 38B located in a parallel spaced relation. The side walls 38A and 38B are of a diameter greater than the diameter of the large blade 14 as shown in FIG. 5. An elongate aperture 46 is provided in each of the side walls 38A and 38B.

The neck 40 is provided with an opening 45 in the top of the neck 40 as shown in FIGS. 4 and 5. The side wall 12B, FIGS. 1 and 3, is provided with a U-shaped slot 50 in the neck 40 which defines a resilient tab 52 having an actuator button 54 formed on the end of the tab 52.

Figure 9:
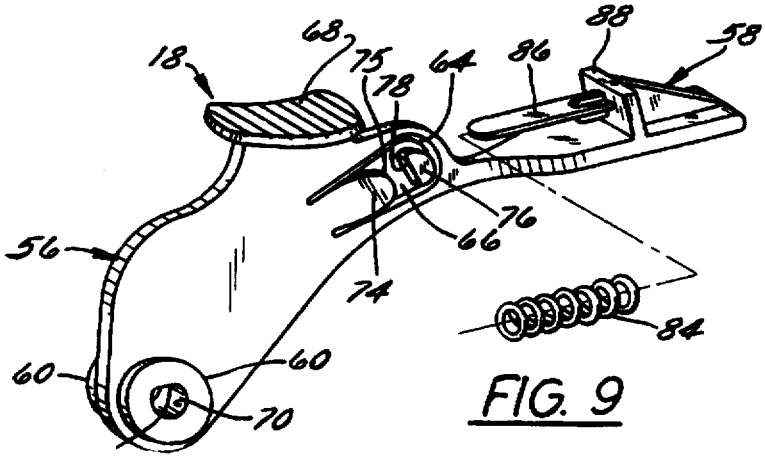
FIG. 9 is an exploded view of the actuator assembly.

The blade actuator 18 as shown in FIG. 9 generally includes a main body section 56 and a spring retainer assembly 58. In this regard, the spring retainer assembly 58 includes a bracket 88 and a flat spring guide 86 for supporting the spring 84. The spring 84 is mounted on the guide 86 and compressed between the partitions 30 and the bracket 88. The body section 56 includes a boss 60 on each side having a bolt opening 62. A U-shaped slot 64 is provided in the actuator to form a tab resilient 66. A current button 68 is provided on the actuator for moving the actuator to the operative positions. The bosses 60 are aligned with the opening 70 in the side surfaces 38A and 38B. A flat section 72 is provided in the opening 70.

Figure 10:
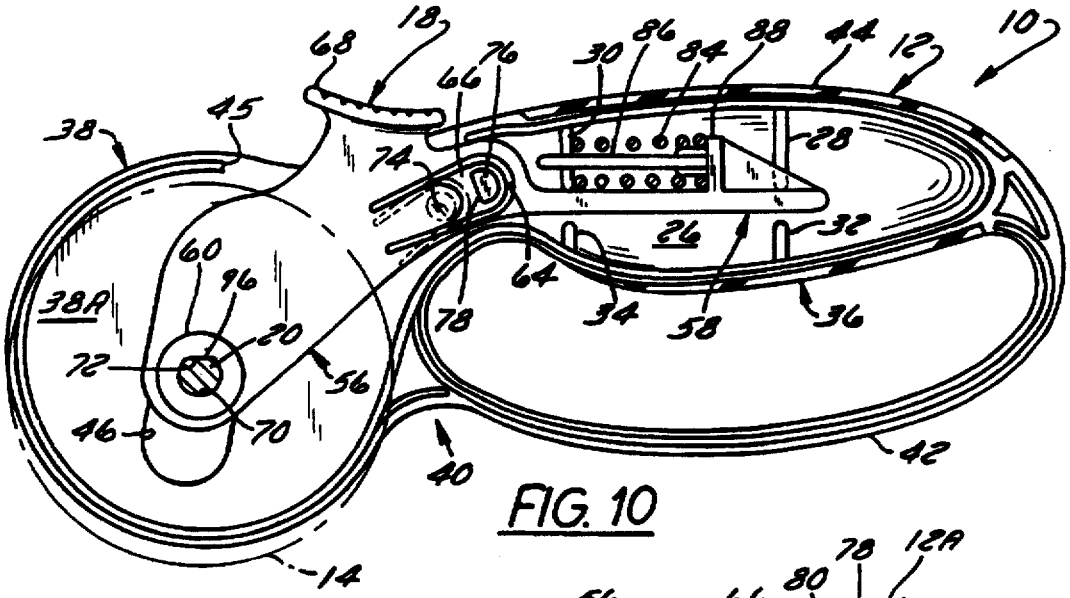
FIG. 10 is a view similar to FIG. 7 showing the large blade in the operative position.
Figure 10A:
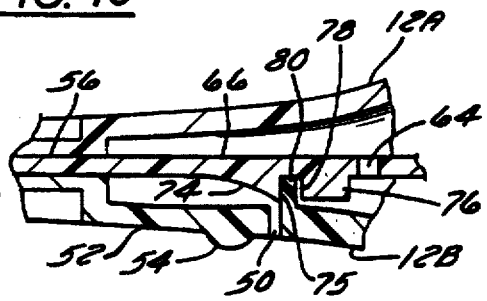
FIG. 10A is a cross-sectional view of the actuator button shown in the retracted position.
Figure 11:
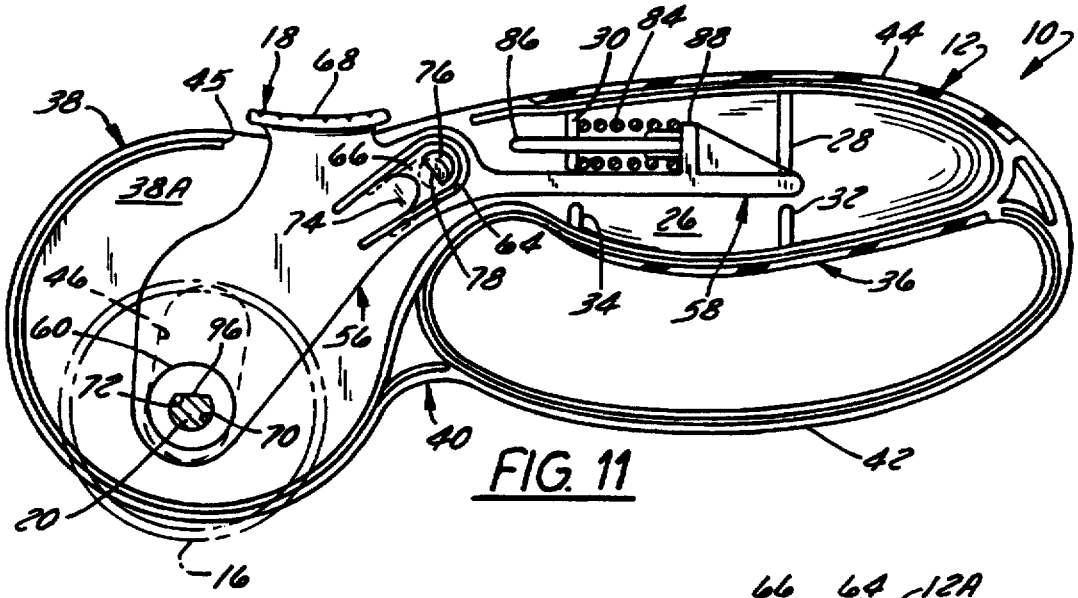
FIG. 11 is a view similar to FIG. 10 showing the actuator in the small blade position.
Figure 10B:
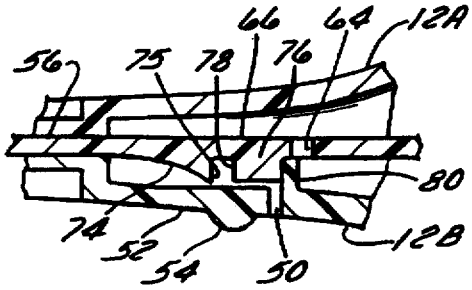
FIG. 10B is a cross-sectional view of the actuator button in the small blade position.

Referring to FIGS. 10A and 10B, a ramp 74 and a button 76 are formed on the inside surface of tab 66. The button 76 has a flat face 78 which matingly engages 80 formed on the inside of the sidewall 12B. When the actuator 18 is in the retracted position as shown in FIGS. 10A and 10B, the sloped surface of ramp 74 will be located adjacent the tab 80 on the side wall 12A. When the actuator 18 is moved to the extended or first operative position, the tab 80 will force the ramp 74 inward until the ramp clears the tab 80. When the ramp 74 clears the tab 80, the ramp 74 will snap back aligning the tab 80 with the flat surface 75 of the ramp 74 and locking the actuator in the operative or first cutting position as shown in FIG. 10A. The actuator is released by pressing the button 54 on tab 52 inward against the ramp 74 to clear the tab 80 which allows the actuator to return to the inoperative position.

To extend the blade actuator 18 outwardly to accommodate a 45 mm diameter blade the actuator button 54 is depressed to clear the ramp 74 and the button 76 from the tab 80 in the side wall 12B as shown in FIG. 10B. When the button 76 clears the tab 80, the button 76 will snap back aligning the button 76 with the tab 80 and locking the actuator 16 in the operative or cutting position as shown in FIG. 10B. The actuator is retracted by pressing the button 54 on tab 52 inward against the button 78 to clear the tab 80 on the side wall 12A. The button 54 must be pressed again to clear the ramp 74 over the tab 80.

The spring retainer 58, provided on the end of the actuator 18, supports the compression spring 84 as noted above. The spring 84 is aligned with the flat member 86 in abutting engagement with a bracket 88 formed on the end of the actuator 18. The member 86 is aligned in the space between the partitions 30. The spring 84 is aligned with the member 86 and compressed between the bracket 88 and the partitions 30.

The actuator 18 is moved between open and closed positions by means of the button 68 provided on the edge of the actuator 56 and is aligned with the opening 45 in the head 38. The blade 14 is moved to the operative position by pushing the button 68 forward.

Figure 8:
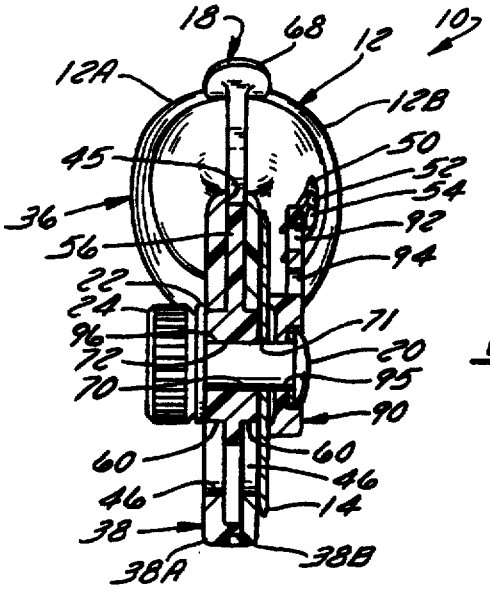
FIG. 8 is a view taken on line 8—8 of FIG. 7 showing the position of the large blade mounted on the end of the actuator.

The circular blade 14 is shown in FIG. 8 mounted on the boss 60 by means of the bolt 20 which passes through a triangular opening 70 in circular blade 14. The spring washer 22 and retainer nut 24 are mounted on the bolt 20 on the opposite side to retain the blade in abutting engagement with the boss 60.

A blade guard 90 is provided on the top portion of the blade 16 to protect the operator from engaging the upper quarter section of the blades 14 or 16. In this regard and referring to FIG. 3 the guard 90 includes a pair of arcuate openings 92 and 94 and a bolt hole (not shown). The retainer bolt 20 is also provided with a flat section 96 which matingly engages the flat section 72 in the blade guard in the boss 60 to prevent the safety guard 90 from rotating with the blade 14 or 16.

Thus, it should be apparent that there has been provided in accordance with the present invention a double blade actuator for a hand held cutter that fully satisfies the objectives and advantages set forth above.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A rotary cutter comprising:

a handle, a cylindrical head formed on one end thereof, said handle and head having an internal cavity, an actuating member mounted in said cavity, a blade support formed on the actuating member for movement between a storage position and one of two operating positions with respect to the head, a spring mounted on the actuating member for biasing the actuating member to a storage position in the internal cavity, and a latch assembly formed in the actuating member for selectively locking the actuating member in one of the two operating positions.

2. The rotary cutter according to claim 1 wherein said locking means comprises a first tab formed in the side wall of the handle and a stop formed on the inside of the sidewall and a second tab formed in the actuating member, said second tab including a ramp and a button aligned with said first tab whereby said ramp will ride up the stop when the actuating member is moved to the first operating position.

3. The rotary cutter according to claim 2 wherein said first tab includes a button formed on the end of the tab for releasing the second tab from the stop whereby said spring will bias the actuating member to the storage position.

4. A hand held rotary paper cutter including a handle, a cylindrical head formed on one end of the handle, a planar surface provided on one side of the head, the handle and head having an internal cavity, an actuating member mounted in said cavity, a spring biasing said actuating member to a storage position in said handle, and a circular cutting blade mounted on said actuating member in a parallel relation to said planar surface, the improvement comprising:

a U shaped slot in the side wall of the handle forming a resilient tab, a stop formed in the handle at the end of the tab, and a U shaped slot formed in the actuating member forming a resilient tab having a ramp and a button aligned with the stop in the handle whereby said ramp rides up the stop when the actuating member is moved to the first cutting position.

5. The rotary paper cutter according to claim 4 wherein said resilient tab is released from the stop by pressing the first button into engagement with the ramp to release the ramp from the stop and moving the actuating member to the second position to lock the actuating member in the second position.

* * * * *

UNITED STATES PATENT AND TRADEMARK OFFICE

CERTIFICATE OF CORRECTION

PATENT NO. : 5,711,077

DATED : January 27, 1998

INVENTOR(S) :

William J. Schulz and Brian L. Adkinson

It is certified that error appears in the above-identified patent and that said Letters Patent is hereby corrected as shown below:

In Column 2, line 47, delete "fig 4 & 5" and insert --Fig. 4--.
In Column 2, line 59, delete "bolt opening 62" and insert --bolt opening 70--.
In Column 2, line 60, delete "tab resilient" and insert –resilient tab--.
In Column 2, line 60, delete "current" and insert –curved--.
In Column 3, line 2, delete "10A and 10B" and insert –10A--.
In Column 3, line 40, delete "70" and insert --71--.
In Column 3, line 49, delete "bolt hole" and insert --bolt hole 95--.

Signed and Sealed this

Twenty-ninth Day of June, 1999

*Attest:*

Q. TODD DICKINSON

*Attesting Officer*

*Acting Commissioner of Patents and Trademarks*